US008157513B2

(12) United States Patent
Takeshita et al.

(10) Patent No.: US 8,157,513 B2
(45) Date of Patent: Apr. 17, 2012

(54) AXIAL FLOW FAN

(75) Inventors: Hidenobu Takeshita, Kyoto (JP); Toshikazu Fukunaga, Kyoto (JP); Tsunenori Tatsuno, Kyoto (JP)

(73) Assignee: Nidec Corporation, Kyoto (JP)

( * ) Notice: Subject to any disclaimer, the term of this patent is extended or adjusted under 35 U.S.C. 154(b) by 1043 days.

(21) Appl. No.: 12/099,829

(22) Filed: Apr. 9, 2008

(65) Prior Publication Data

US 2009/0081036 A1 Mar. 26, 2009

(30) Foreign Application Priority Data

Apr. 12, 2007 (JP) ..... 2007-104440

(51) Int. Cl.
*F04D 29/54* (2006.01)

(52) U.S. Cl. ..... 415/191; 415/208.2; 415/211.2; 415/121.1

(58) Field of Classification Search ..... 415/191, 415/192, 121.1, 206, 208.2, 210.1, 208.1; 416/247 R See application file for complete search history.

(56) References Cited

U.S. PATENT DOCUMENTS

| | | | | |
|---|---|---|---|---|
| 3,178,099 | A * | 4/1965 | Child | 415/119 |
| 4,927,324 | A * | 5/1990 | Coup et al. | 415/121.2 |
| 5,951,245 | A * | 9/1999 | Sullivan | 415/192 |
| 6,017,191 | A * | 1/2000 | Harmsen | 416/247 R |
| 6,398,492 | B1 * | 6/2002 | Cho et al. | 415/191 |
| 6,601,546 | B1 * | 8/2003 | Mohr et al. | 123/41.49 |
| 6,910,862 | B2 * | 6/2005 | Horng et al. | 415/211.2 |
| 6,997,678 | B2 * | 2/2006 | Sun | 415/211.2 |
| 7,018,175 | B2 | 3/2006 | Horng et al. | |
| 7,118,332 | B2 | 10/2006 | Horng et al. | |
| 7,334,988 | B2 | 2/2008 | Horng et al. | |
| 2005/0025620 | A1 | 2/2005 | Horng et al. | |
| 2005/0186070 | A1 * | 8/2005 | Zeng et al. | 415/211.2 |
| 2006/0147304 | A1 * | 7/2006 | Cho et al. | 415/191 |

FOREIGN PATENT DOCUMENTS

| | | |
|---|---|---|
| JP | 56-41840 | 4/1981 |
| JP | 3103807 | 6/2004 |
| JP | 2005076590 | 3/2005 |

* cited by examiner

*Primary Examiner* — Igor Kershteyn
(74) *Attorney, Agent, or Firm* — Keating & Bennett, LLP

(57) ABSTRACT

An axial flow fan according to the present invention comprises an impeller which rotates about a central axis and including a plurality of blades, a hollow member accommodating therein the impeller, a base portion which is arranged at the hollow member and supports the base portion in a rotatable manner, a plurality of inner air guide members each connected to the base portion, and a plurality of outer air guide members each connected to the hollow member.
The inner air guide members and the outer air guide members each include a first edge member and a second edge portion. A length of the first edge member and that of the second edge member of the outer air guide member are greater than those of the first edge member and the second edge member of the inner air guide member.

15 Claims, 15 Drawing Sheets

AXIAL FLOW FAN

BACKGROUND OF THE INVENTION

1. Field of the Invention

The present invention relates to an axial flow fan.

2. Description of the Related Art

In recent years, various electronic equipments have been becoming smaller and smaller. Also, the amount of heat generated by electronic devices in the electronic equipments has been greater. However, such devices fail if temperature of their electronic equipments or processor units becomes too high. Therefore, a fan which is usually arranged inside an electronic device is typically used to cool the electronic components and processor units of the electronic device.

For example, an axial flow fan is often used to cool the electronic components and processor units of the electronic device. The axial flow fan typically includes a housing which accommodates therein an impeller which rotates centered about the central axis thereof. The impeller typically includes a cup having a substantially cylindrical shape, and a plurality of rotor blades each extending radially outwardly. When the impeller rotates, an air flow is generated flowing along the axial direction.

Generally, the axial flow fan is expected to generate a large quantity of air flow having a high static pressure. In order to increase the quantity of air flow, for example, a number of rotations of the impeller may be increased. On the other hand, in order to increase the static pressure of the air flow, a stator blade or a plurality thereof may be arranged at an outlet side of the axial flow fan.

The stator blades are usually arranged so as to adjust the air flow generated by the rotation of the impeller. The air flow typically includes an axial flow component, a swirling flow component centered about the central axis, and a centrifugal component of the air flow flowing in the axial direction. When the air flow makes contact with the stator blade, the swirling flow component of the air flow is adjusted to the axial flow component, whereby the static pressure of the air flow is improved.

However, the dimension and shape of the stator blade needs to be adjusted in accordance with the quantity of the air flow flowing through the housing. In general, the quantity of air flow flowing near the area of the cup of the impeller is smaller than that flowing near a radially outer area of the rotor blade.

Also, since the air flow generated by the rotation of the impeller includes the swirling flow component and the centrifugal component, when the air flow is outletted from the housing, the air flow will spread radially outwardly. When the air flow spreads radially outwardly, the fan does not effectively cool the heated electronic components and processor units of an electronic device.

SUMMARY OF THE INVENTION

In order to overcome the problems described above, an axial flow fan according to preferred embodiments of the present invention comprises an impeller rotatable about a central axis and including a plurality of blades, a hollow member accommodating therein the impeller, a base portion arranged at the hollow member and supporting the impeller in a rotatable manner, a plurality of inner air guide members each connected to the base member, a plurality of outer air guide members each connected to the hollow member, and a connecting member connecting the inner air guide members and the outer air guide members. The inner air guide members and the outer air guide members each include a first edge portion and a second edge portion, and a length of the outer air guide member defined between the first edge portion and the second edge portion thereof is equal to or greater than that of the inner air guide member. By virtue of such configuration, the axial flow fan according to the present invention is operable to reduce the friction between the air flows generated by the rotation of the impeller, and therefore improve the characteristics of the air flow related to static pressure and the quantity of the air flow.

Other features, elements, steps, characteristics and advantages of the present invention will become apparent from the following detailed description of preferred embodiments thereof with reference to the attached drawings.

DETAILED DESCRIPTION OF THE PREFERRED EMBODIMENT

Figure 1:
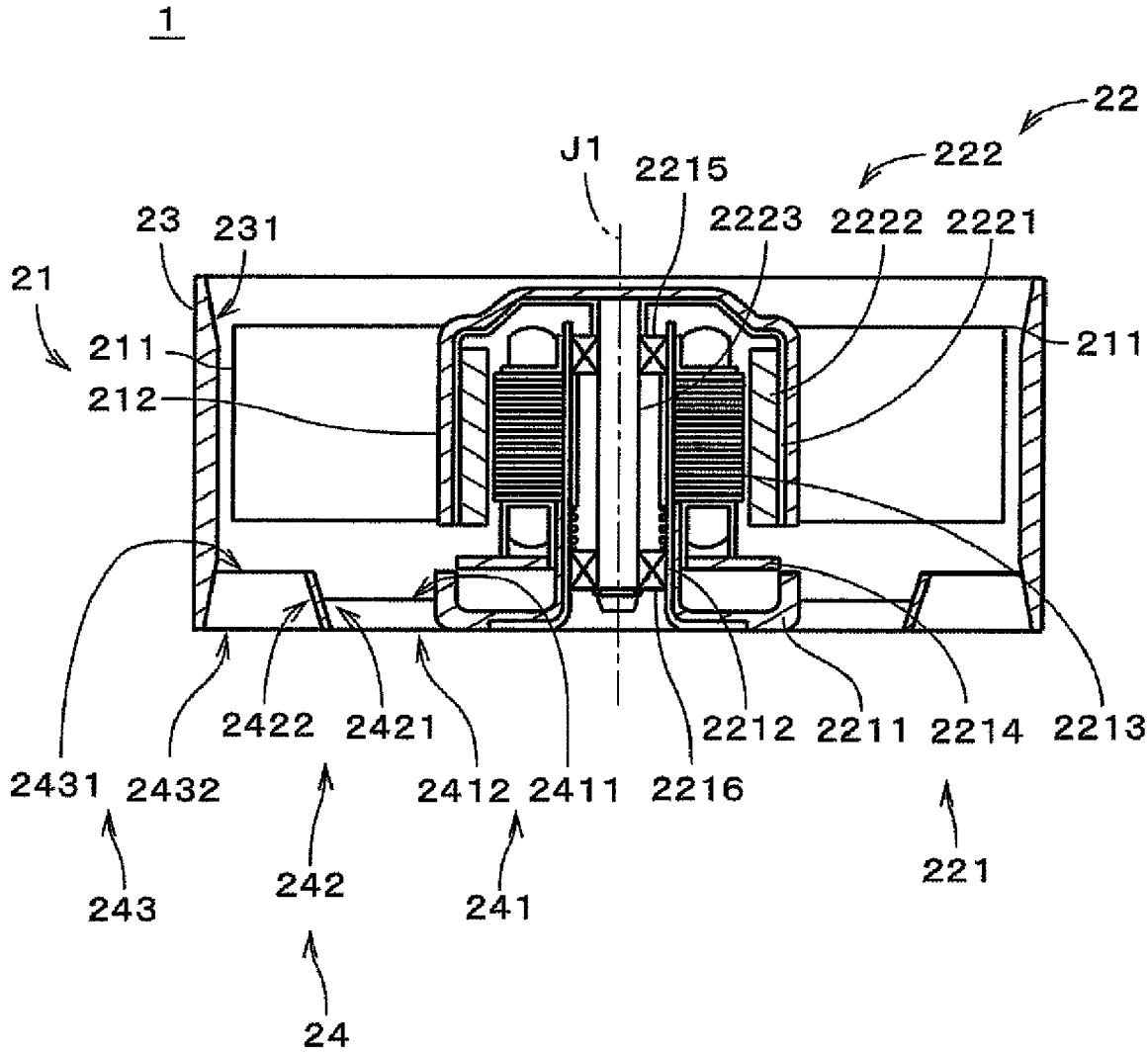
FIG. 1 is a schematic cross sectional view of an axial flow fan according to a first preferred embodiment of the present invention.

Note that in the description of preferred embodiments of the present invention herein, words such as upper, lower, left, right, upward, downward, top, and bottom for describing positional relationships between respective members and directions merely indicate positional relationships and directions in the drawings. Such words do not indicate positional relationships and directions of the members mounted in an actual device. Also note that reference numerals, figure numbers, and supplementary descriptions are shown below for assisting the reader in finding corresponding components in the description of the preferred embodiments below to facilitate an understanding of the present invention. It is understood that these expressions in no way restrict the scope of the present invention. Also note that in the description hereafter, an upper side and a lower side of the axial flow fan 1 in accordance with FIG. 1 will be respectively referred to as an "inlet side" and an "outlet side" of the axial flow fan.

Figure 2:
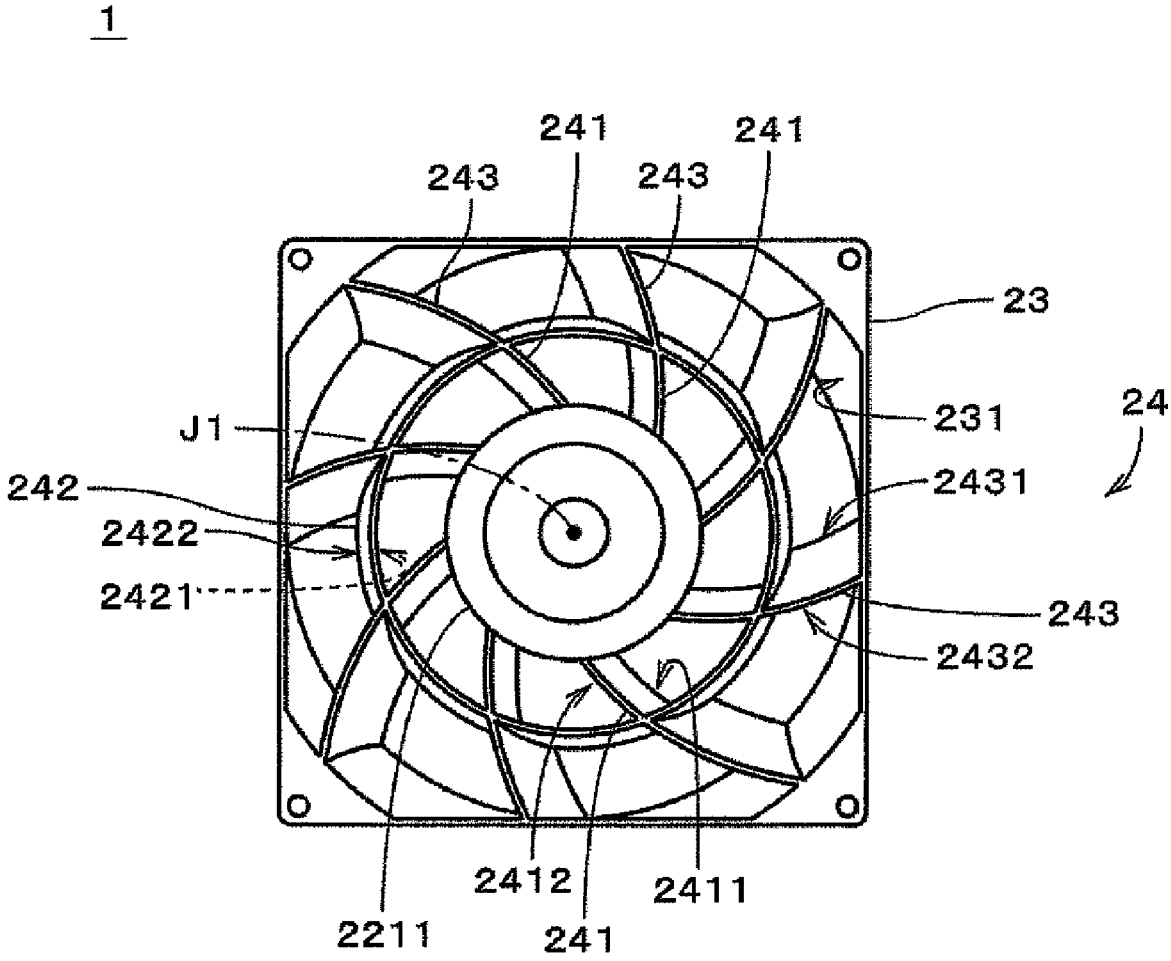
FIG. 2 is a schematic bottom view of the axial flow fan according to the first preferred embodiment of the present invention.

FIG. 1 is a schematic cross sectional view of the axial flow fan 1 according to a first preferred embodiment of the present invention. According to the axial flow fan 1, an air flow travels along a central axis J1 (i.e., from top to bottom in FIG. 1). FIG. 2 is a schematic bottom view of the axial flow fan 1 according to the first preferred embodiment as viewed from an outlet side thereof.

As shown in FIG. 1, the axial flow fan 1 preferably includes the central axis J1, an impeller 21, a motor portion 22, a housing 23, and a support portion 24.

As shown in FIG. 2, the housing 23 is a substantially hollow member preferably including a rectangle shape when viewed from an axial end thereof. Also as shown in FIG. 2, an inner circumferential surface 231 of the housing 23 preferably includes a substantially round shape. The housing 23 preferably accommodates therein the impeller 21, the motor portion 22 and the support portion 24.

As shown in FIG. 1, the impeller 21 preferably includes a plurality of rotor blades 211 and a cup 212 having a substantially cylindrical shape. The rotor blades 211, arranged evenly in a circumferential direction centered about the central axis J1, each preferably extend outwardly from an outer circumferential surface of the cup 212 in a radial direction. Note that the rotor blades 211 and the cup 212 are formed continuously as a single component by an injection molding using a resin material. When the impeller 21 is rotated by the motor portion 22, an air flow will be generated inside the housing 23 centered about the central axis J1.

The motor portion 22 which is preferably supported by the support portion 24 includes a stator portion 221 and a rotor portion 222.

The rotor portion 222 preferably includes a yoke 2221, a field magnet 2222 and a shaft 2223. The yoke 2221 is preferably made of a metal material and includes a substantially cylindrical shape with a lid portion. The yoke 2221 preferably includes a protruded portion having a substantially cylindrical shape and protruding toward the outlet side at a substantially central area of the lid portion. The yoke 2221 is preferably fitted at the cup 212 and is secured by press fitting or the like. The field magnet 2222 preferably having a substantially cylindrical shape is secured to an inner circumferential surface of the yoke 2221 via an adhesive or the like. The shaft 2223 preferably includes a portion which is secured to the protruded portion at the lid portion of the yoke 2221.

The stator portion 221 preferably includes a base portion 2211, a bearing portion 2212, an armature 2213 and a circuit board 2214.

The base portion 2211 is preferably secured to the inner circumferential surface 231 of the housing 23 via the support portion 24. Also, the base portion 2211 preferably retains the circuit board 2214, and the bearing portion 2212 and armature 2213 of the stator portion 221.

The circuit board 2214 preferably includes a substantially discoid shape and is arranged axially below the armature 2213. The circuit board 2214 is preferably connected to the armature 2213 electrically via a jig (not shown) arranged at the armature 2213. Also, the circuit board 2214 is preferably connected to an external power source (not shown) via a plurality of lead wires (not shown). The external power source preferably supplies to the circuit board 2214 electric current and transmits control signal to the circuit board 2214 so as to control the armature 2213.

The armature 2213 is preferably supported by the base portion 2211 and is arranged opposite to the field magnet 2222. When an electric current is supplied to the armature 2213 from the external power source, a magnetic force will be generated at the armature 2213.

Due to an interaction between the magnetic force generated at the armature 2213 and that generated at the field magnet 2222, a torque centered about the central axis J1 will be generated between the armature 2213 and the field magnet 2222. The torque rotates the rotor portion 222, which then rotates centered about the central axis J1 the impeller 21 and the rotor blades 211, which then generates an air flow in the axial direction.

Also, the bearing portion 2212 preferably includes a substantially cylindrical shape and is protrudingly arranged upwardly at the substantially central portion of the base portion 2211. The bearing portion 2212 preferably includes a ball bearing 2215 and a ball bearing 2216 at the inner circumferential surface of the bearing portion 2212. The shaft 2223 is preferably arranged inside the bearing portion 2212 and rotatably supported by the ball bearings 2215 and 2216.

As shown in FIG. 2, the support portion 24 preferably includes a plurality (eight in the present preferred embodiment) of inner air guide members 241, a connecting member 242, and a plurality (eight in the present preferred embodiment) of outer air guide members 243.

As shown in FIGS. 1 and 2, the connecting member 242 preferably includes a substantially annular shape centered about the central axis J1 and a cross section thereof in the axial direction includes a substantially rectangle shape. Note that an inner side surface 2421 and an outer side surface 2422 of the connecting member 242 are preferably inclined with respect to the central axis J1. That is, an inner diameter of the connecting member 242 becomes preferably smaller toward the outlet side thereof compared with that of the inlet side thereof. By virtue of such configuration, the connecting member 242 is operable to guide the air flow generated by the impeller 21 to a preferable direction.

As shown in FIGS. 1 and 2, the inner air guide member 241 preferably extends outwardly in the radial direction from the base portion 2211 and is connected to the inner side surface 2421 of the connecting member 242. The outer air guide member 243 preferably extends inwardly in the radial direction from the inner side surface 231 of the housing 23 and is connected to the outer side surface 2422 of the connecting member 242. Also, as shown in FIG. 2, the inner air guide members 241 are connected to the connecting member 242 at the portions thereof corresponding to the outer air guide members 243.

Note that the support portion 24, the housing 23 and the base portion 2211 are formed by a method such as an injection molding, an aluminum die casting or the like as an integral member. By virtue of such configuration, the support portion 24, the housing 23 and the base portion 2211 are formed efficiently. It is to be noted, however, although the present preferred embodiment assumes that a manufacturing method of the aforementioned elements is as described above, the manufacturing method is not limited thereto.

Figure 3:
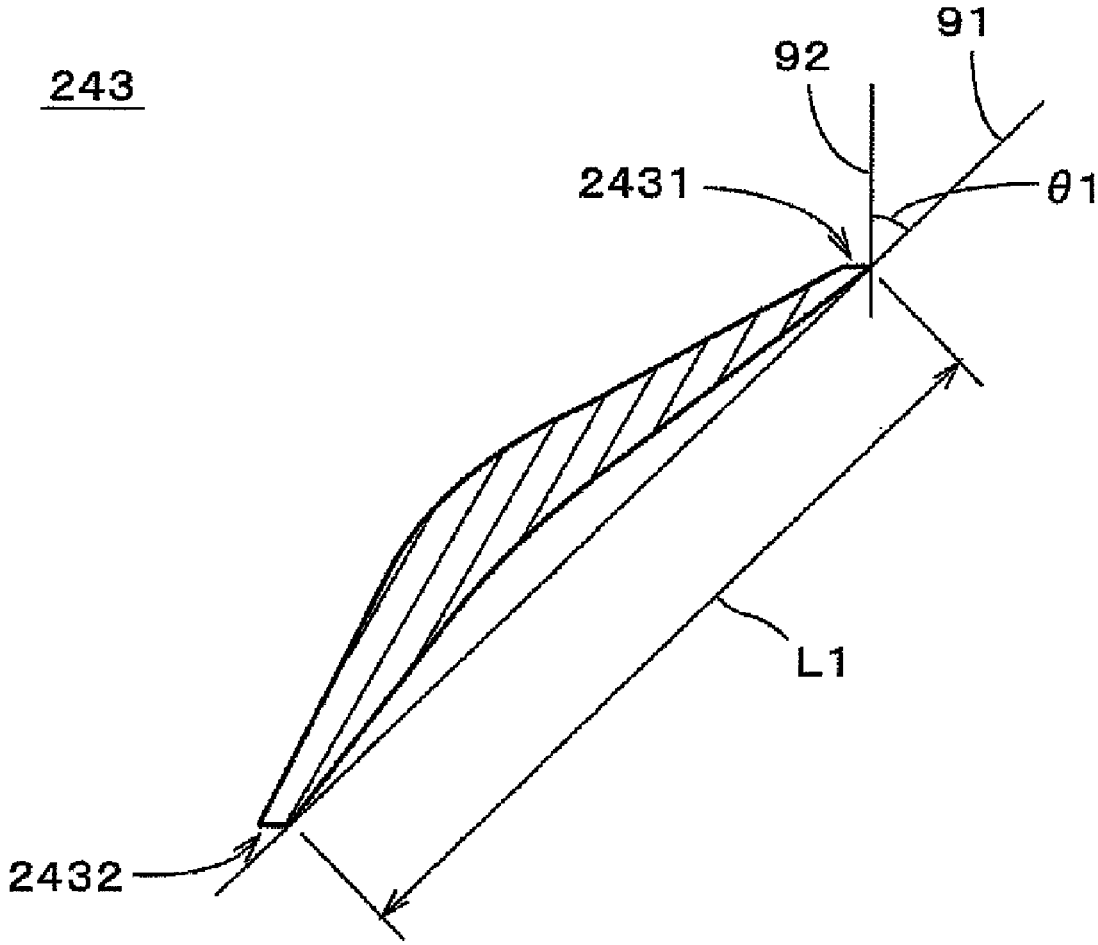
FIG. 3 is a schematic cross sectional view of an outer air guide member according to the first preferred embodiment of the present invention.

FIG. 3 is a schematic cross sectional view of the outer air guide member 243 when viewed perpendicularly with respect to the direction the outer air guide member 243 extends. The outer air guide member 243 preferably includes a first edge portion 2431 and a second edge portion 2432. According to the present preferred embodiment, the first edge portion 2431 is preferably arranged at the inlet side with respect to the second edge portion 2432 which is preferably arranged at the outlet side.

As shown in FIG. 3, the outer air guide member 243 preferably includes a substantially blade shape. Also, the outer air guide member 243 preferably includes a substantially arched shape with respect to a straight line 91, which is, as shown in FIG. 3, a virtual straight line preferably connecting the first edge portion 2431 and the second edge portion 2432.

Also, the outer air guide member 243 is preferably inclined with respect to the central axis J1. An angle (hereafter, θ1) of the outer air guide member 243 with respect to the central axis J1 is defined by a straight line 92 which is substantially parallel with the central axis J1 and the straight line 91.

Figure 4:
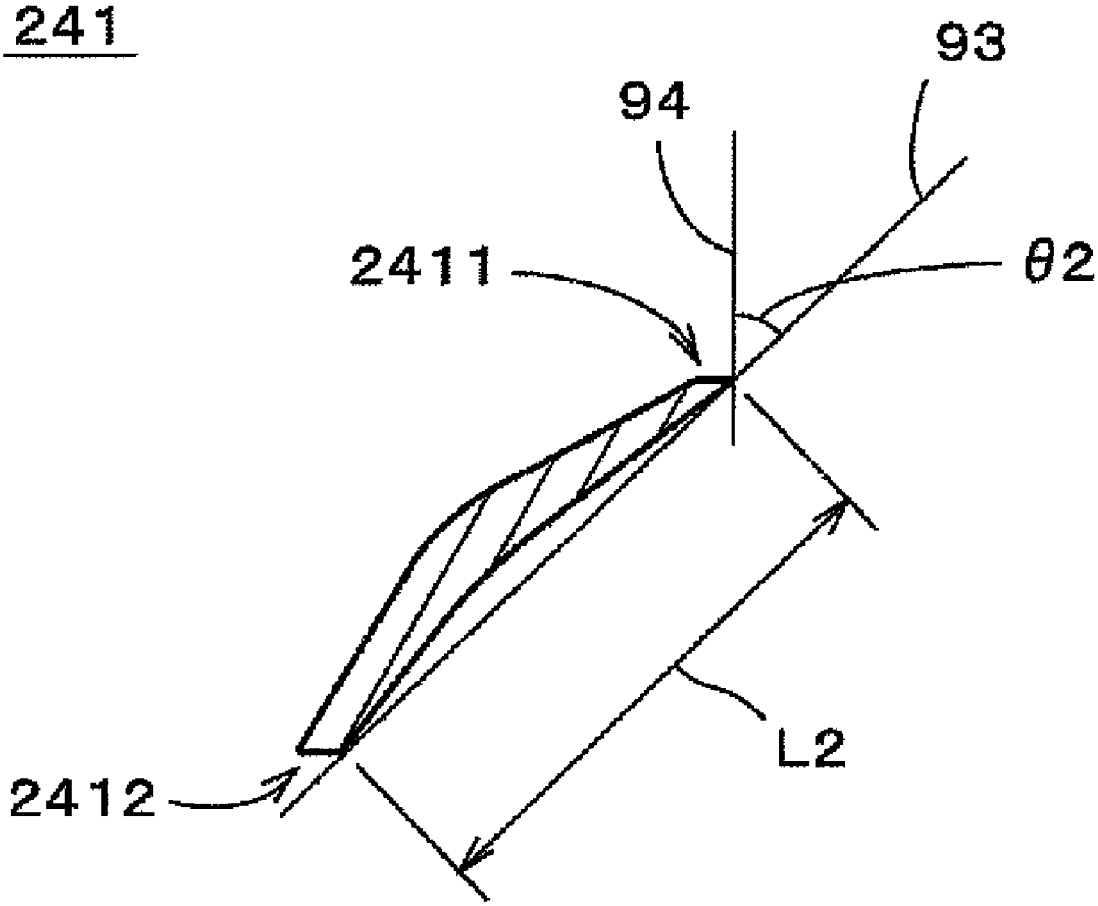
FIG. 4 is a schematic cross sectional view of an inner air guide member according to the first preferred embodiment of the present invention.

FIG. 4 is a schematic cross sectional view of the inner air guide member 241 when viewed perpendicularly with respect to the direction the inner air guide member 241 extends. The inner air guide member 241 preferably includes a first edge portion 2411 and a second edge portion 2412. According to the present preferred embodiment, the first edge portion 2411 is preferably arranged at the inlet side with respect to the second edge portion 2412 which is preferably arranged at the outlet side.

As shown in FIG. 4, the inner air guide member 241 preferably includes a substantially blade shape. Also, the inner air guide member 241 preferably includes a substantially arched shape with respect to a straight line 93, which is, as shown in FIG. 4, a virtual straight line preferably connecting the first edge portion 2411 and the second edge portion 2412.

Also, the inner air guide member 241 is preferably inclined with respect to the central axis J1. An angle (hereafter, θ2) of the inner air guide member 241 with respect to the central axis J1 is defined by a straight line 94 which is substantially parallel with the central axis J1 and the straight line 93.

Also, as shown in FIGS. 3 and 4, according to the present preferred embodiment, θ1 defined by the straight line 91 and the straight line 92 is substantially equal to θ2 defined by the straight line 93 and the straight line 94.

Further, as shown in FIGS. 1 through 4, according to the present preferred embodiment, the outer air guide member 243 is preferably larger than the inner air guide member 241. As shown in FIG. 1, an axial height of the outer air guide member 243 is preferably the same as that of the connecting member 242, and is greater than that of the inner air guide member 241. As shown in FIG. 2, the outer air guide member 243 is preferably longer in the substantially radial direction than the inner air guide member 241. As shown in FIGS. 3 and 4, L1 which is a distance between the first edge portion 2431 and the second edge portion 2432 of the outer air guide member 243 is preferably greater than L2 which is a distance between the first edge portion 2411 and the second edge portion 2412 of the inner air guide member 241.

It is to be appreciated that as the impeller 21 rotates the rotor blades 211 make contact with air wherein a portion of the rotor blade 211 arranged radially outwardly makes greater contact with air than a portion of the rotor blade 211 arranged radially inwardly. That is, a greater quantity of air flow is generated by the rotor blades 211 at radially outerward portion.

Therefore, if a dimension of the outer air guide member 243 is made larger than that of the inner air guide member 241, the air flow generated by the impeller 21 is more likely to collide with the outer air guide member 242. That is, a swirling flow component of the air flow generated by the rotation of the impeller 21 is converted into an axial flow component by the outer air guide member 243. Consequently, the air flow outletted from the housing 23 is more likely to flow in the substantially axial direction rather than in the radially outward direction. Further, characteristics of the air flow related to static pressure and quantity of air flow will be improved.

Also, since the inner air guide member 241 is made smaller than the outer air guide member 243, the air flow generated within the housing is less likely to be affected (i.e., interrupted) by inner air guide member 241. By virtue of such configuration, noise which may be generated when the air flow makes contact with the inner air guide member 241 will be minimized.

Also, according to the present preferred embodiment as shown in FIG. 1, since the outer air guide member 243, the connecting member 242, and the inner air guide member 241 are all preferably arranged on a substantially even surface at the outlet side thereof, the air flow passing through the support portion 24 is less likely to be interrupted thereby. By virtue of such configuration, noise which may be generated when the air flow makes contact with the support portion 24 will be minimized.

Note that although the present preferred embodiment assumes that the outer air guide member 243, the connecting member 242, and the inner air guide member 241 are all arranged on a substantially even surface at the outlet side thereof, the present invention is not limited thereto; only the outer air guide member 243 and the connecting member 242 may be arranged on a substantially even surface at the outlet side thereof. As described above, since the quantity of the air flow flowing at the area near the outer air guide member 243 is greater than that at the area near the inner air guide member 241, when the outer air guide member 243 and the connecting member 242 are arranged on a substantially even surface, the air flow flowing in the axial direction is less likely to be interrupted. Also, the outer air guide member 243 and the connecting member 242 may be arranged on a substantially even surface at the inlet side thereof. Also, the outer air guide member 243 and the connecting member 242 may be arranged on a substantially even surface at both inlet side and the outlet side thereof.

Also, the connecting member 242 is preferably arranged radially between the inner air guide member 241 and the outer air guide member 243, and is preferably connected to the inner air guide member 241 and the outer air guide member 243. By virtue of such configuration, durability of the entire support portion 24 will be improved.

Also, since the durability of the entire support portion 24 is improved, a small number of the inner air guide members 241 and the outer air guide members 243 are required to support the base portion 2211 with respect to the housing 23. According to the axial flow fan 1 of the present preferred embodiment, when the impeller 21 rotates at a slow speed, the quantity of air flow generated by the impeller 21 is small. In particular, the slow speed means approximately 3000 $min^{-1}$ to approximately 4000 $min^{-1}$ for a small size fan which, for example, includes a side (of four sides of a housing as seen in FIG. 2) of approximately 60 mm, and approximately 1000 $min^{-1}$ to approximately 2000 $min^{-1}$ for a large size fan which, for example, includes a side of 120 mm. According to the present preferred embodiment, even when the rotation speed of the impeller 21 is slow, the static pressure of the air flow generated by the impeller 21 is improved since the number of the inner air guide members 241 and that of the outer air guide members 243 are minimized.

Note that θ1 defining the inclination of the outer air guide member 243 with respect to the central axis J1 is not restricted to being constant with respect to the direction the outer air guide member 243 extends. Also note that θ2 defining the inclination of the inner air guide member 241 with respect to the central axis J1 is not restricted to being constant with respect to the direction the inner air guide member 241 extends. It is preferable that θ1 defines an average angle of the inclinations of a minimal line connecting the first edge portion 2431 and the second edge portion 2432 of the outer air guide member 243 taken at various portions thereof.

Hereafter, an axial flow fan 2 according to a second preferred embodiment of the present invention will be described. Note that elements for the second preferred embodiment similar to those described for the first preferred embodiment will be denoted by similar reference numerals, and description thereof is omitted.

Figure 5:
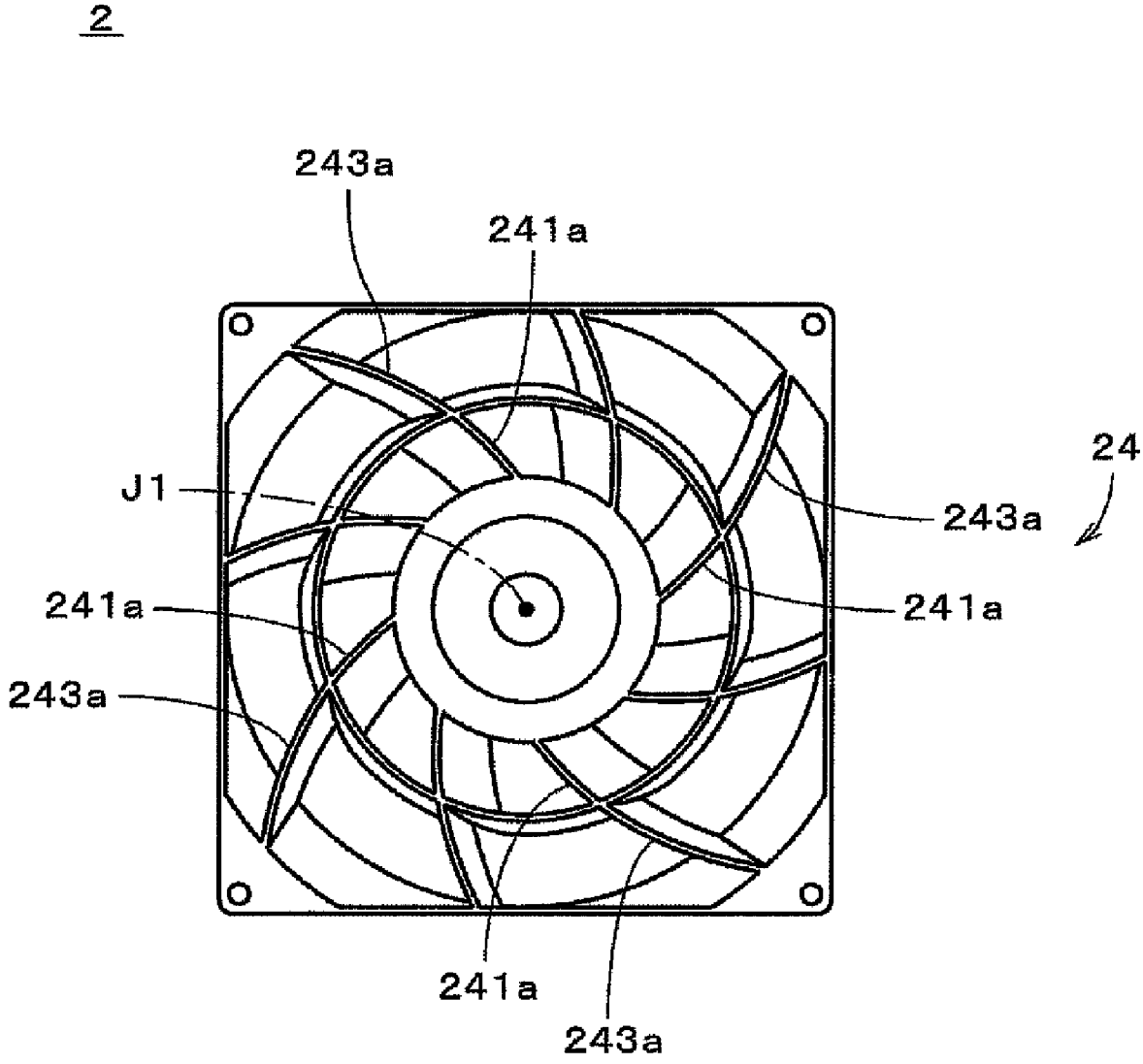
FIG. 5 is a schematic bottom view of an axial flow fan according to a second preferred embodiment of the present invention.

FIG. 5 is a schematic bottom view of the axial flow fan 2 according to the second preferred embodiment when viewed from the outlet side thereof. As shown in FIG. 5, the axial flow fan 2 according to the second preferred embodiment is identical with the axial flow fan 1 according to the first preferred embodiment except that a plurality of outer air guide members 243*a* and a plurality of inner air guide member 241*a* are preferably inclined differently with respect to the central axis J1 than their counter parts in the first preferred embodiment.

Figure 6:
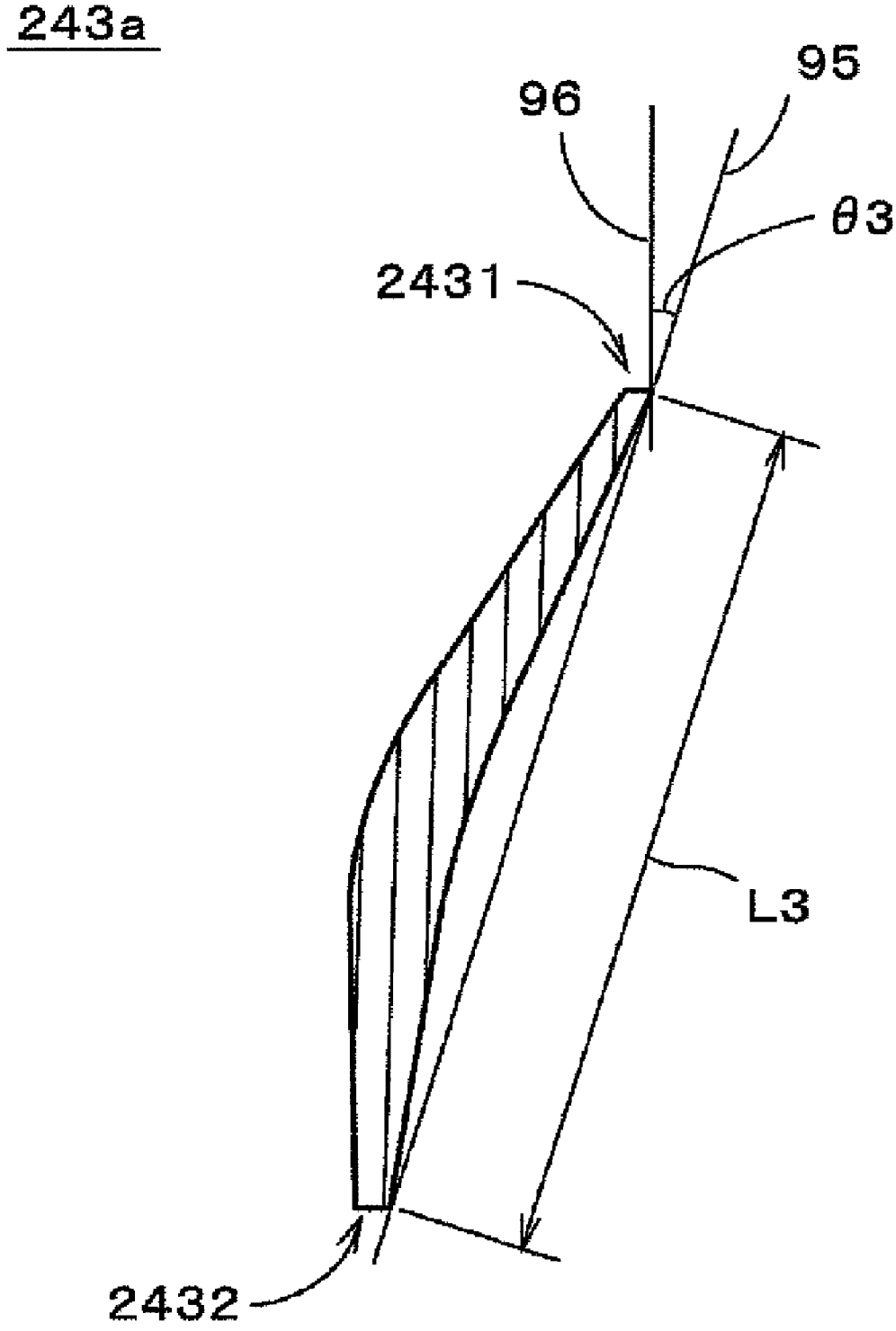
FIG. 6 is a schematic cross sectional view of an outer air guide member according to the second preferred embodiment of the present invention.

FIG. 6 is a schematic cross sectional view of the outer air guide member 243*a* according to the second preferred embodiment when viewed substantially perpendicularly with respect to the direction the outer air guide member 243 extends. As shown in FIG. 6, the outer air guide member 243*a* preferably includes a substantially blade shape. Also, the outer air guide member 243*a* preferably includes the first edge portion 2431 and the second edge portion 2432. A straight line 95 which, as shown in FIG. 6, is a virtual straight line preferably connecting the first edge portion 2431 and the second edge portion 2432 of the outer air guide member 243. Also, as shown in FIG. 6, a straight line 96 is a substantially straight line parallel with the central axis J1.

Figure 7:
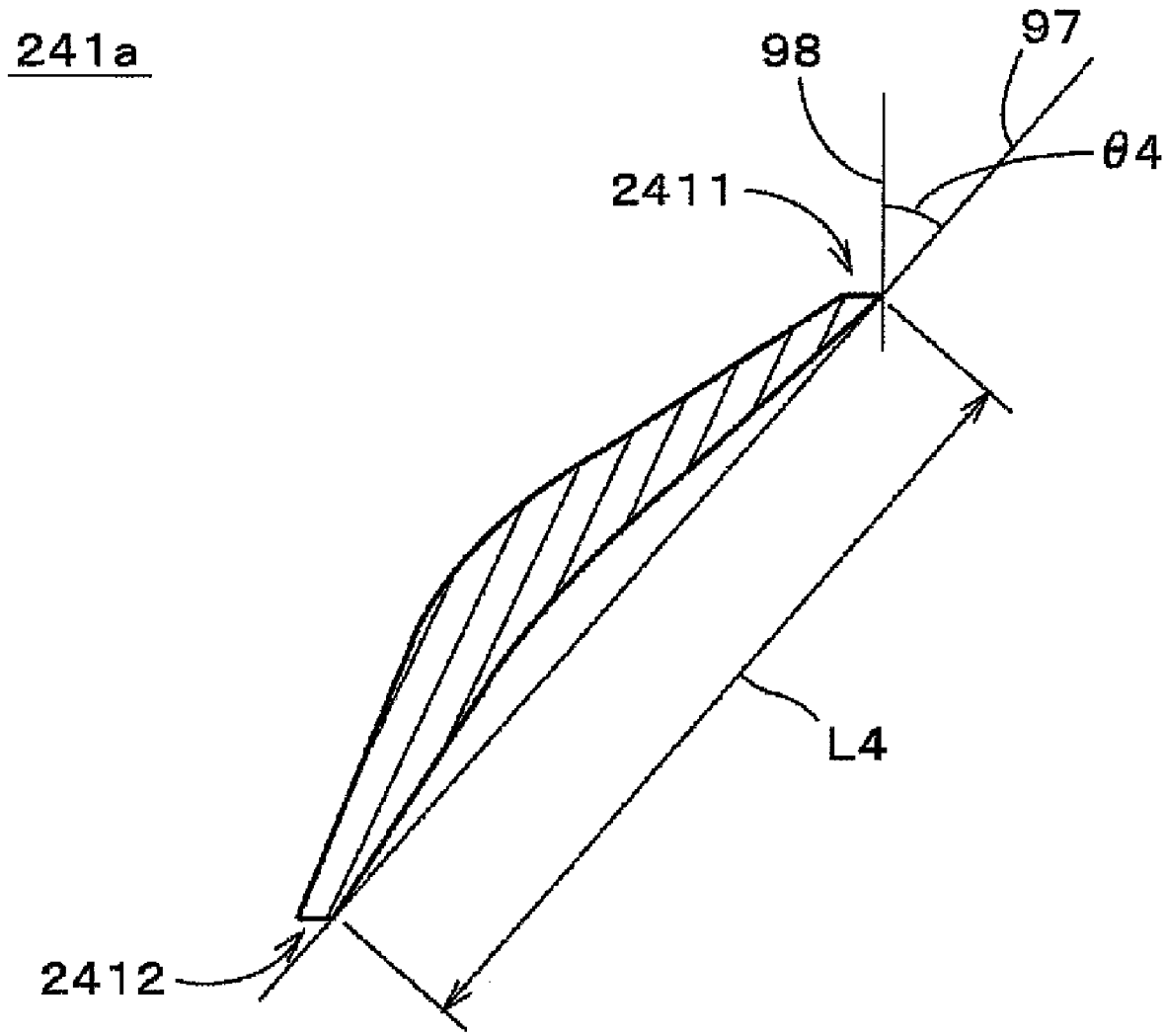
FIG. 7 is a schematic cross sectional view of an inner air guide member according to the second preferred embodiment of the present invention.

FIG. 7 is a schematic cross sectional view of the inner air guide member 241*a* according to the second preferred embodiment when viewed substantially perpendicularly with respect to the direction the inner air guide member 241*a* extends. As shown in FIG. 7, the inner air guide member 241*a* preferably includes a substantially blade shape. Also, the inner air guide member 241*a* preferably includes the first edge portion 2411 and the second edge portion 2412. As shown in FIG. 7, a straight line 97 is a virtual straight line preferably connecting the first edge portion 2411 and the second edge portion 2412 of the inner air guide member 241*a*. Also, as shown in FIG. 7, a straight line 98 is a substantially straight line parallel with the central axis J1.

An angle (hereafter, θ3) of the outer air guide member 243*a* with respect to the central axis J1 is defined by the straight line 95 and the straight line 96. Also, an angle (hereafter, θ4) of the inner air guide member 241*a* with respect to the central axis J1 is defined by the straight line 97 and the straight line 98. Note that θ3 is preferably smaller than θ4, as shown in FIGS. 6 and 7. That is to say that, the inner air guide member 241*a* is preferably inclined more toward the air flow generated by the rotation of the impeller 21 than the outer air guide member 243*a*.

Also, as can be seen from FIGS. 6 and 7, the cross sectional dimension of the outer air guide member 243*a* is substantially the same as that of the inner air guide member 241*a*. Also, as can be seen from FIGS. 6 and 7, L3 which is a distance (i.e., width of the blade of the outer air guide member 243*a*) defined between the first edge portion 2431 and the second edge portion 2432 of the outer air guide member 243*a* is substantially the same as L4 which is a distance (i.e., width of the blade of the inner air guide member 241*a*) defined between the first edge portion 2411 and the second edge portion 2412 of the inner air guide member 241.

As shown in FIG. 5, according to the present preferred embodiment, a circumferential width of the outer air guide member 243*a* as viewed from one axial end is preferably smaller than that of the inner air guide member 241*a*. Also, according to the present preferred embodiment, as shown in FIGS. 6 and 7, an axial length of the outer air guide member 243*a* is preferably smaller than that of the inner air guide member 241*a*.

By virtue of the configuration of the outer air guide member 243*a* and that of the inner air guide member 241*a* as described above, the swirling flow component of the air flow flowing the radially outer area (i.e., an area near the inner circumferential surface 231 of the housing 23) in the axial direction is preferably adjusted to an axial flow component by the outer air guide member 243*a*. Consequently, the air flow will be guided toward a desirable direction while the static pressure thereof is improved. Also, even when the quantity of air flow flowing the radially inward area (i.e., an area near the central axis J1) in the axial direction is small, the inner air guide member 241*a* hardly interferes with the air flow such that the characteristics of the air flow related to static pressure and quantity of air flow will be improved.

Hereafter, an axial flow fan 3 according to a third preferred embodiment of the present invention will be described. Note that elements for the third preferred embodiment similar to those described for the second preferred embodiment will be denoted by similar reference numerals, and description thereof is omitted.

Figure 8:
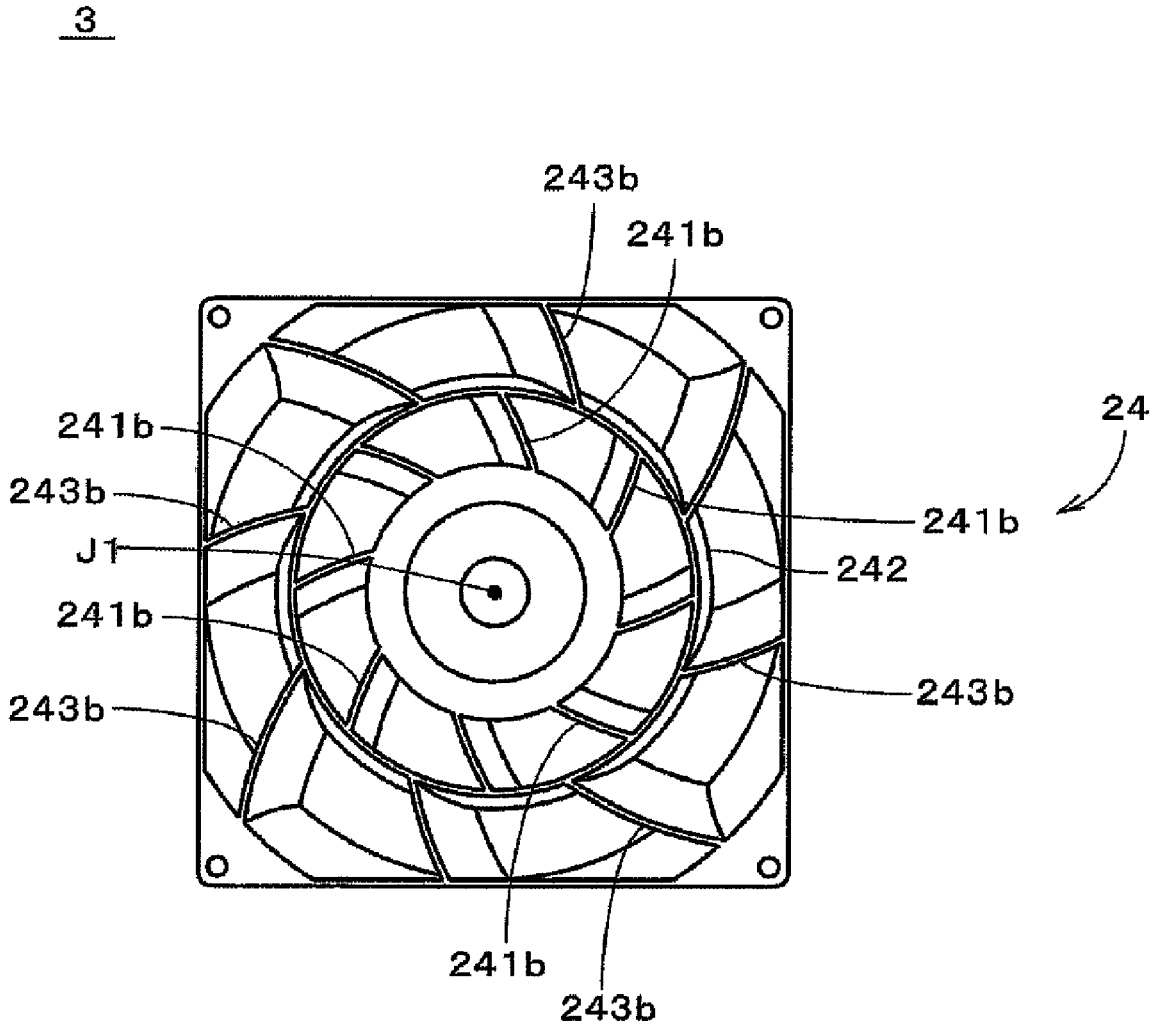
FIG. 8 is a schematic bottom view of an axial flow fan according to a third preferred embodiment of the present invention.

FIG. 8 is a schematic bottom view of the axial flow fan 3 according to the third preferred embodiment as viewed from the outlet side thereof. An outer air guide member 243*b* preferably extends from the inner circumferential surface 231 of the housing 23 and is connected to the connecting member 242 in the same manner as the outer air guide member 243 of the first preferred embodiment. The axial flow fan 1 according to the first preferred embodiment is identical with the axial flow fan 3 according to the third preferred embodiment except that the outer air guide member 243*b* and the inner air guide member 241*b* according to the third preferred embodiment connect to the connecting member 242 differently than their counter parts of the first preferred embodiment.

By virtue of the configuration as described above, the characteristics of the air flow related to static pressure and quantity of air flow according to the present preferred embodiment will be improved in the similar manner as the first preferred embodiment.

Also, as described above, due to the connection between the outer air guide member 243*b* and the connecting member 242, and that between the inner air guide member 241*b* and the connecting member 242 as shown in FIG. 8, an interference between the air flow flowing the area near the outer air guide member 243*b* in the axial direction and that flowing the area near the inner air guide member 241*b* in the axial direction will be preferably minimized. Consequently, the noise generated by the interference of the air flows will be minimized.

Hereafter, an axial flow fan 4 according to a fourth preferred embodiment of the present invention will be described.

Note that elements for the fourth preferred embodiment similar to those described for the previous preferred embodiment will be denoted by similar reference numerals, and description thereof is omitted. Note that the axial flow fan 4 according to the fourth preferred embodiment is identical with that of the third preferred embodiment except that the support portion 24 is configured differently.

Figure 9:
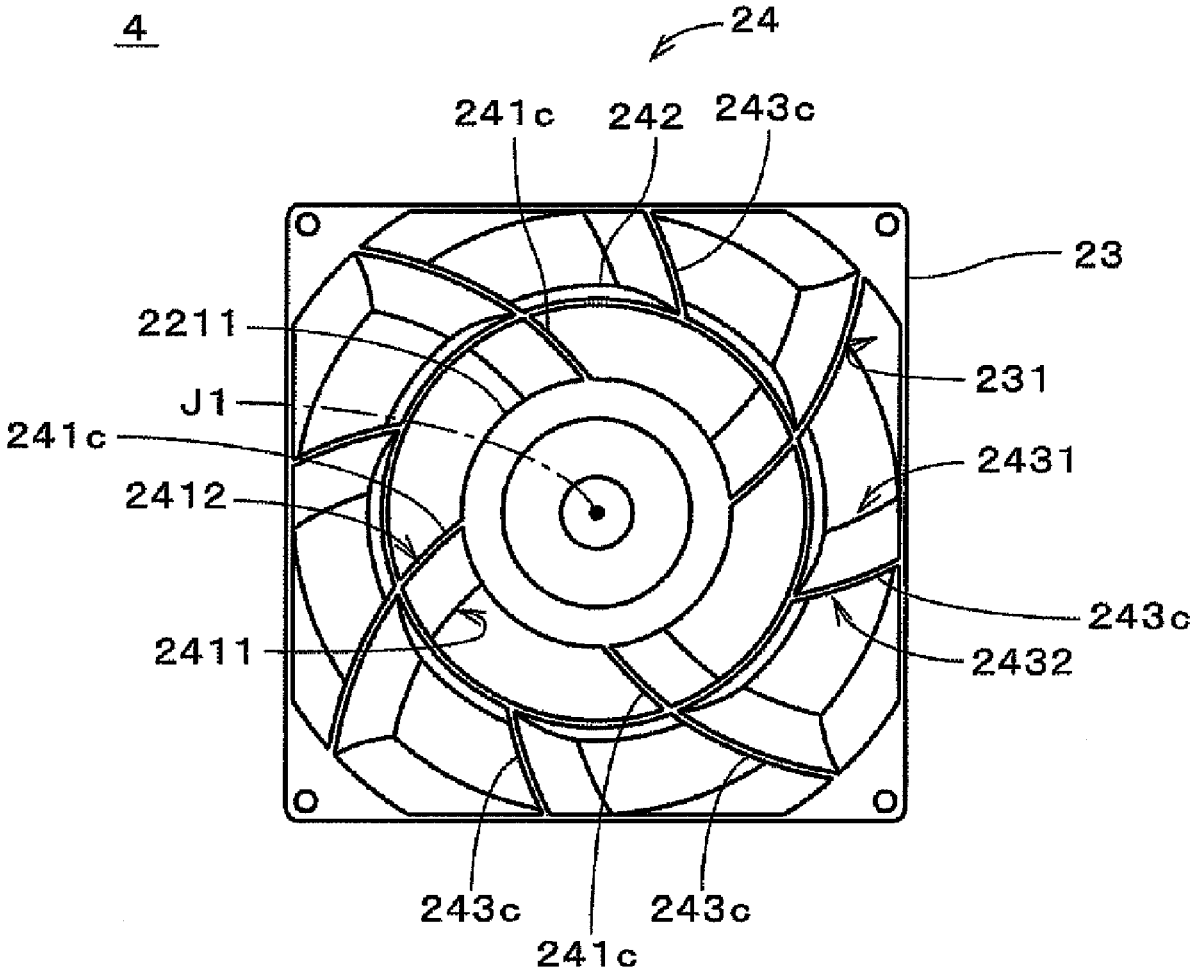
FIG. 9 is a schematic bottom view of an axial flow fan according to a fourth preferred embodiment of the present invention.

FIG. 9 is a schematic bottom view of the axial flow fan 4 according to the fourth preferred embodiment as viewed from the outlet side thereof. According to the present preferred embodiment, the support portion 24 preferably includes the connecting member 242, a plurality (four in the present preferred embodiment) of inner air guide members 241*c*, and a plurality (eight in the present preferred embodiment) of outer air guide members 243*c*. The connecting member 242 is preferably a substantially annular member centered about the central axis J1. The inner air guide member 241*c* preferably extends radially outwardly from the base portion 2211, and is connected to the connecting member 242.

Note that although the present preferred embodiment assumes that the axial flow fan 4 includes eight outer air guide members 243*c* and four inner air guide member 241*c*, the present invention is not limited thereto.

As with the previous preferred embodiments, the outer air guide member 243*c* preferably includes the first edge portion 2431 and the second edge portion 2432. Also, the inner air guide member 241*c* preferably includes the first edge portion 2411 and the second edge portion 2412.

Also, in the same manner as the first preferred embodiment, a distance between the first edge portion 2431 and the second edge portion 2432 of the outer air guide member 243*c* is substantially the same as that between the first edge portion 2411 and the second edge portion 2412 of the inner air guide member 241.

Also, the inclination of the outer air guide member 243*c* with respect to the central axis J1 is substantially equal to that of the inner air guide member 241*c* with respect to the central axis J1.

As described above, although the quantity of air flow flowing at the radially outer area is greater than that flowing the radially inward area, since the number of the outer air guide members 243*c* is greater than that of the inner air guide members 241*c*, the air flow will be adjusted toward a desirable direction in accordance with the quantity of the air flow, and consequently, the static pressure thereof is improved. By virtue of such configuration, the interference between the air flow flowing the area near the outer air guide member 243*c* and that flowing the area near the inner air guide member 241*c* will be minimized.

Note that the number of the outer air guide member 243*c* and that of the inner air guide member 241*c* are not limited to as described above as long as the number of the outer air guide member 243*c* is greater than that of the inner air guide member 241*c*.

Hereafter, an axial flow fan 5 according to a fifth preferred embodiment of the present invention will be described. Note that elements for the fifth preferred embodiment similar to those described for the previous preferred embodiment will be denoted by similar reference numerals, and description thereof is omitted. Note that the axial flow fan 5 according to the fifth preferred embodiment is identical with that of the previous preferred embodiment except that the support portion 24 is configured differently.

Figure 10:
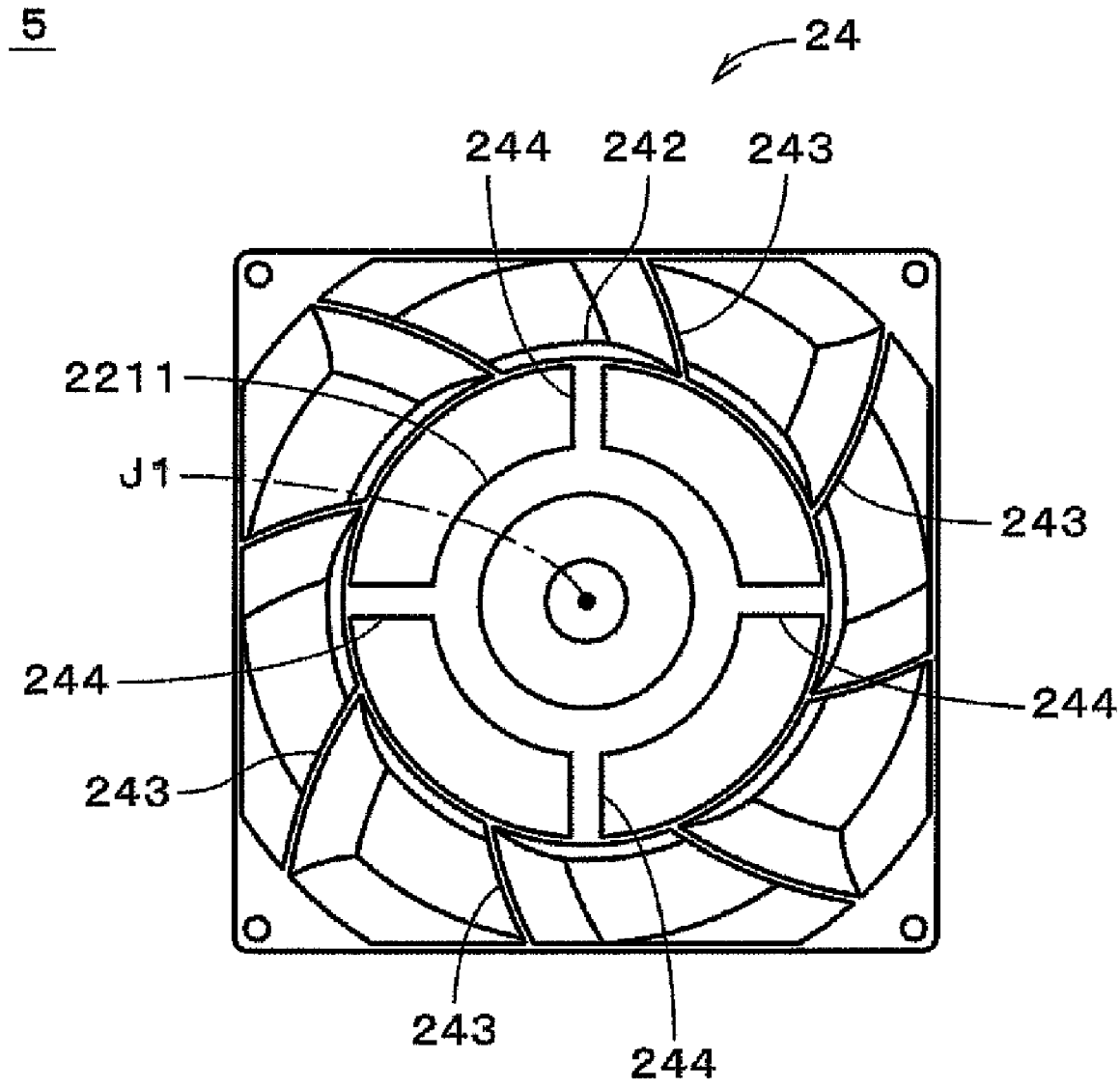
FIG. 10 is schematic bottom view of an axial flow fan according to a fifth preferred embodiment of the present invention.

FIG. 10 is schematic bottom view of the axial flow fan 5 according to the fifth preferred embodiment as viewed from the outlet side thereof. According to the present preferred embodiment, the support portion 24 preferably includes the connecting member 242, a plurality (eight in the present preferred embodiment) of the outer air guide members 243, and a plurality (four in the present preferred embodiment) of inner ribs 244. The connecting member 242 is preferably a substantially annular member centered about the central axis J1. The outer air guide members 243 preferably extend radially outwardly from the inner circumferential surface 231 of the housing 23, and are connected to the connecting member 242. The inner rib 244 preferably includes a substantially stick shape, extends radially outwardly from the base portion 2211, and is connected to the connecting member 242.

Figure 11:
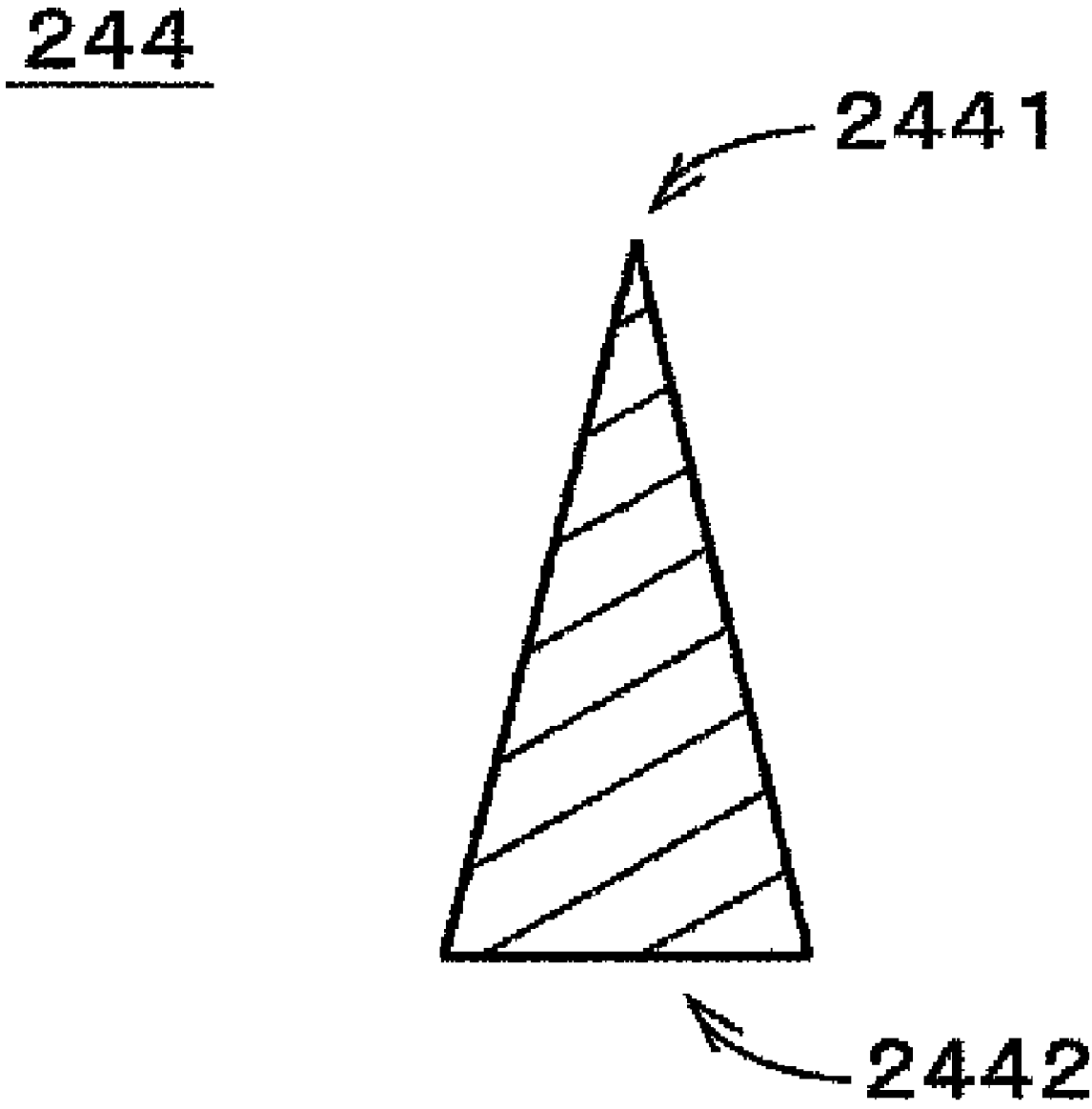
FIG. 11 is a schematic cross sectional view of an inner rib according to the fifth preferred embodiment of the present invention.

FIG. 11 is a schematic cross sectional view of the inner rib according to the fifth preferred embodiment as viewed perpendicularly with respect to the direction the inner rib 244 extends. As shown in FIG. 11, the inner rib 244 preferably includes a first edge portion 2441 and a second edge portion 2442. The first edge portion 2441 is preferably arranged at the inlet side of the inner rib 244, while the second edge portion 2442 is preferably arranged at the outlet side of the inner rib 244. Note that as shown in FIG. 11, the cross sectional view of the inner rib 244 preferably includes a substantially triangle shape in which the same is wider at the outlet side thereof than the inlet side thereof.

Also note that an axial height of the inner rib 244 is smaller than that of the outer air guide member 243. Also, as viewed from one axial end of the axial flow fan 5 according to the present preferred embodiment shown in FIG. 10, the outer air guide member 243 includes a larger surface which makes contact with the air flow generated by the rotation of the impeller 21 than a surface of the inner rib 244. By virtue of such configuration, the noise generated by the air flow when the same makes contact with the inner rib 244 will be reduced. Also, in the same manner as in the previous preferred embodiments, the outer air guide member 243 preferably adjusts the air flow into a desirable direction such that the characteristics of the air flow related to static pressure and quantity of air flow will be improved.

Note that although the present preferred embodiment assumes that the support portion 24 includes the plurality of inner ribs 244, the present invention is not limited thereto. The support portion 24 may include only one inner rib 244 along with a plurality of blade shaped inner air guide members.

Also note that although the present preferred embodiment assumes that the inner rib 244 includes the substantially triangle shape, the present invention is not limited thereto.

Hereafter, an axial flow fan 6 according to a sixth preferred embodiment of the present invention will be described. Note that elements for the sixth preferred embodiment similar to those described for the previous preferred embodiment will be denoted by similar reference numerals, and description thereof is omitted. Note that the axial flow fan 6 according to the sixth preferred embodiment is identical with that of the previous preferred embodiment except that the support portion 24 is configured differently.

Figure 12:
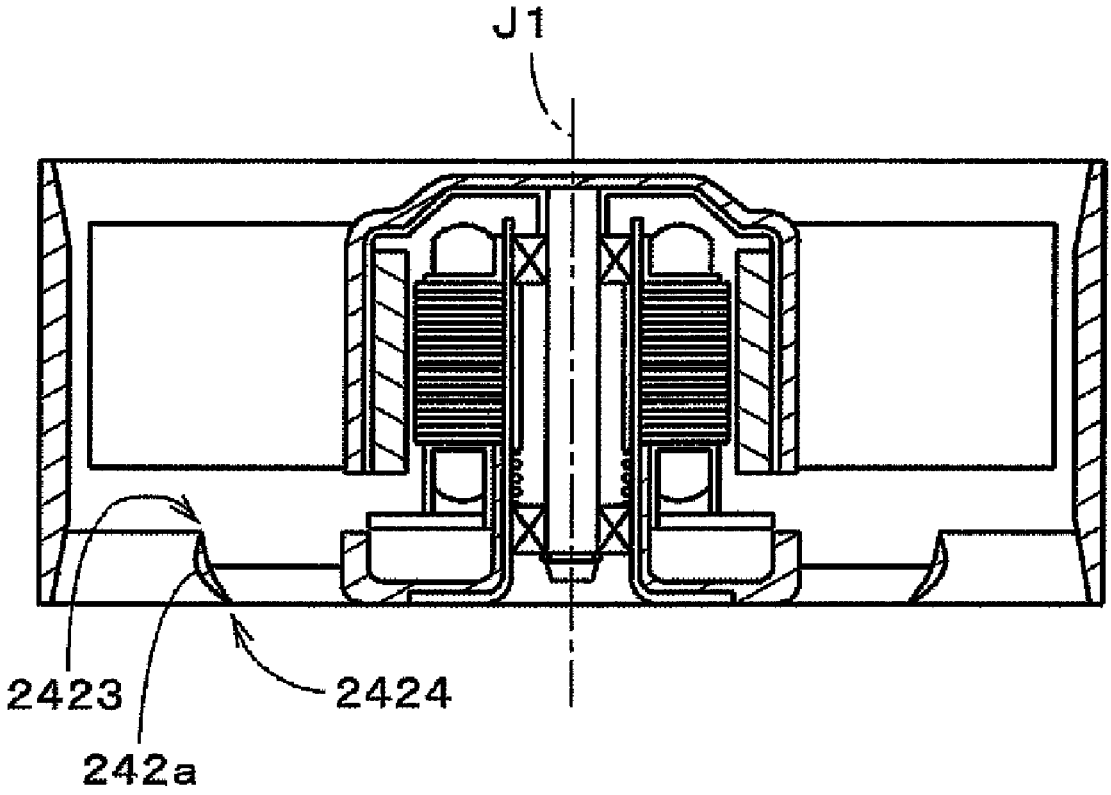
FIG. 12 is a schematic cross sectional view of an axial flow fan according to a sixth preferred embodiment of the present invention.

FIG. 12 is a schematic cross sectional view of the axial flow fan 6 according to the sixth preferred embodiment. Note that a configuration of the axial flow fan 6 according to the sixth preferred embodiment is substantially the same as that of the first preferred embodiment except that a shape of a connecting member 242*a* is different (see FIG. 14) from that of the connecting member 242. The connecting member 242*a* according to the sixth preferred embodiment preferably includes a first edge portion 2423 and a second edge portion 2424.

As shown in FIG. 12, the cross sectional view of the connecting member 242*a* preferably includes a blade shape. By virtue of such configuration, the air flow generated by the rotation of the impeller 21 is preferably adjusted toward a desired direction, thereby improving the static pressure of the air flow is improved. Also, the interference between the air flow flowing the radially inward area and that flowing the radially outward area will be minimized, which consequently reduces the noise generated by the interference between the air flows.

Hereafter, an axial flow according to a seventh preferred embodiment of the present invention will be described. Note that elements for the seventh preferred embodiment similar to those described for the previous preferred embodiments will be denoted by similar reference numerals, and description thereof is omitted. Note that a configuration of the axial flow fan 7 according to the present preferred embodiment is substantially identical to those of the previous preferred embodiments except a configuration of the support portion 24.

Figure 13:
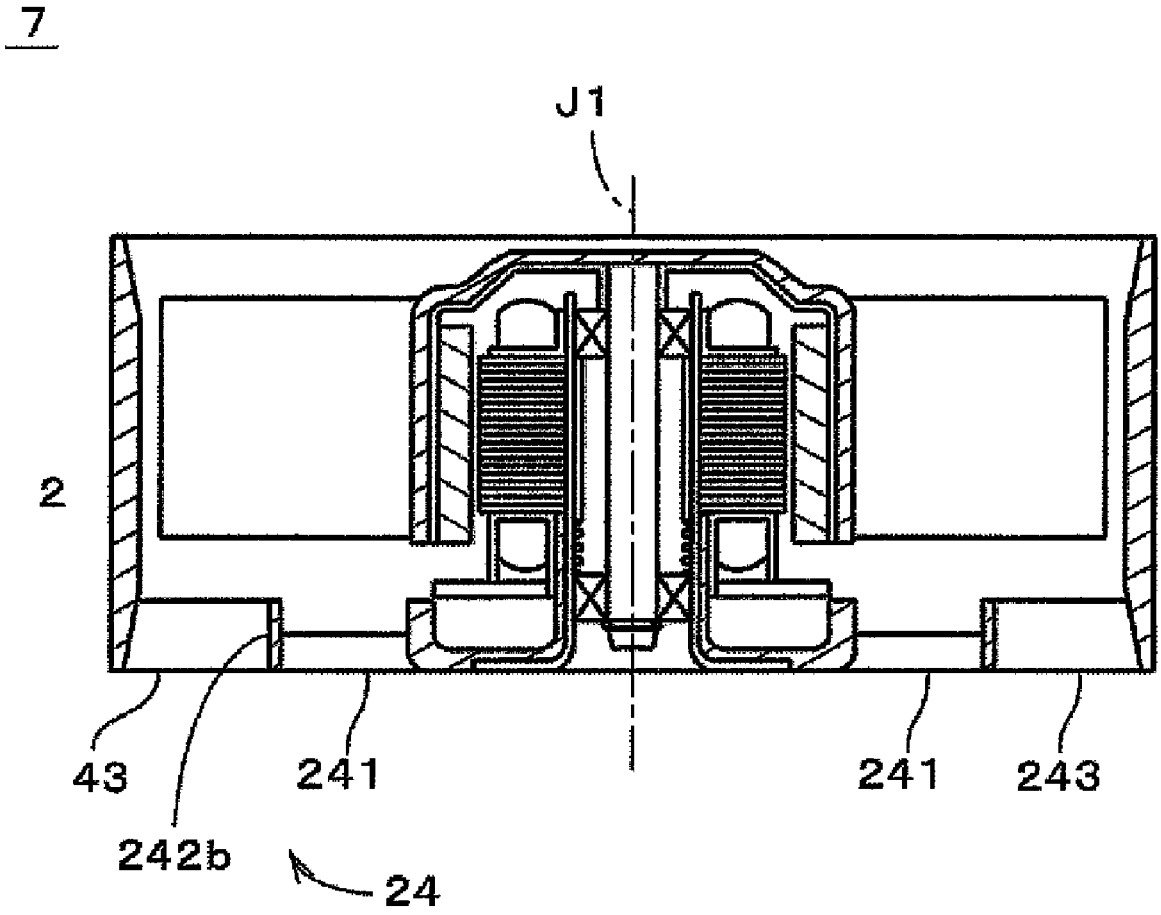
FIG. 13 is a schematic cross sectional view of an axial flow fan according to a seventh preferred embodiment of the present invention.

FIG. 13 is a schematic cross sectional view of the axial flow fan 7 according to the seventh preferred embodiment. As shown in FIG. 13, the support portion 24 preferably includes a connecting member 242*b* having a substantially annular shape centered about the central axis J1, the outer air guide member 243, and the inner air guide member 241.

Also, as shown in FIG. 13, the connecting member 242*b* preferably includes a substantially rectangle shape, and is substantially parallel with the central axis J1. By virtue of such configuration, the air flow generated by the rotation of the impeller 21 is adjusted by the connecting member 242*b* into the substantially axial direction, thereby interference between the air flow flowing the radially inward area and that flowing the radially outward area will be minimized, which consequently reduces the noise generated by the interference of the air flows.

Hereinafter, an axial flow fan 8 according to an eighth preferred embodiment of the present invention will be described. Note that elements for the eighth preferred embodiment similar to those described for the previous preferred embodiments will be denoted by similar reference numerals, and description thereof is omitted. Note that a configuration of the axial flow fan 8 according to the present preferred embodiment is substantially identical to those of the previous preferred embodiments except a configuration of the support portion 24.

Figure 14:
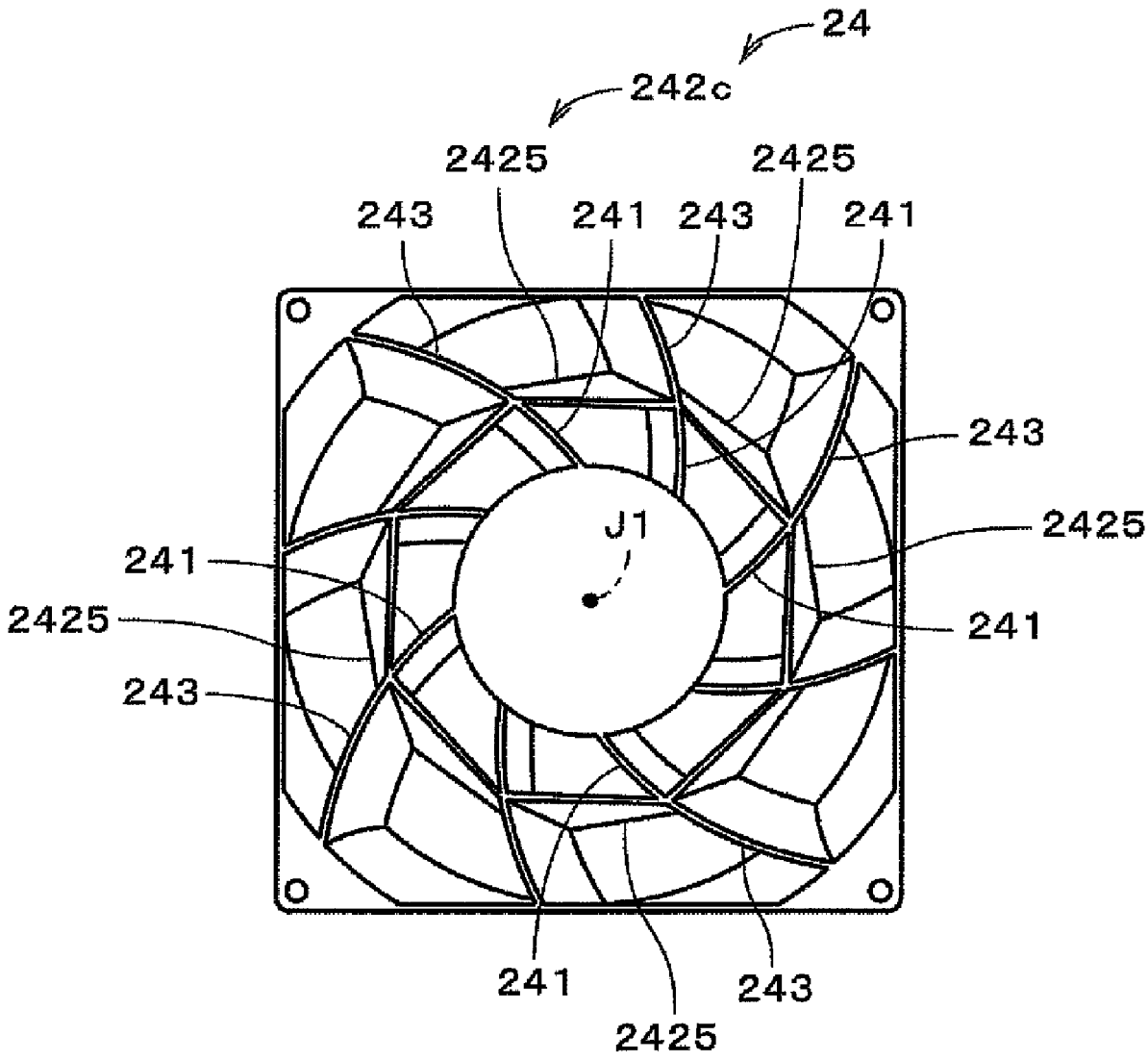
FIG. 14 is a schematic bottom view of an axial flow fan according to an eighth preferred embodiment of the present invention.

FIG. 14 is a schematic bottom view of the axial flow fan 8 according to an eighth preferred embodiment of the present invention. As shown in FIG. 14, the support portion 24 preferably includes a connecting member 242*c*, the outer air guide member 243, and the inner air guide member 241.

As shown in FIG. 14, the connecting member 242*c* preferably includes a plurality of plate members 2425 each having a substantially annular shape centered about the central axis J1. As with the previous preferable embodiments, the inner air guide members 241 and the outer air guide members 243 are preferably connected to the connecting member 242*c*. The connecting member 242*c* is preferably inclined with respect to the central axis J1. In other words, an inner diameter of the connecting member 242*c* is preferably decreased toward the outlet side of the axial flow fan 8. By virtue of such configuration, the air flow generated by the rotation of the impeller 21 is directed toward a preferable direction, and thereby improving the static pressure thereof.

Hereafter, an axial flow fan 9 according to a ninth preferred embodiment of the present invention will be described. Note that elements for the ninth preferred embodiment similar to those described for the previous preferred embodiments will be denoted by similar reference numerals, and description thereof is omitted. Note that a configuration of the axial flow fan 9 according to the present preferred embodiment is substantially identical to those of the previous preferred embodiments except an axial position of the support portion.

Figure 15:
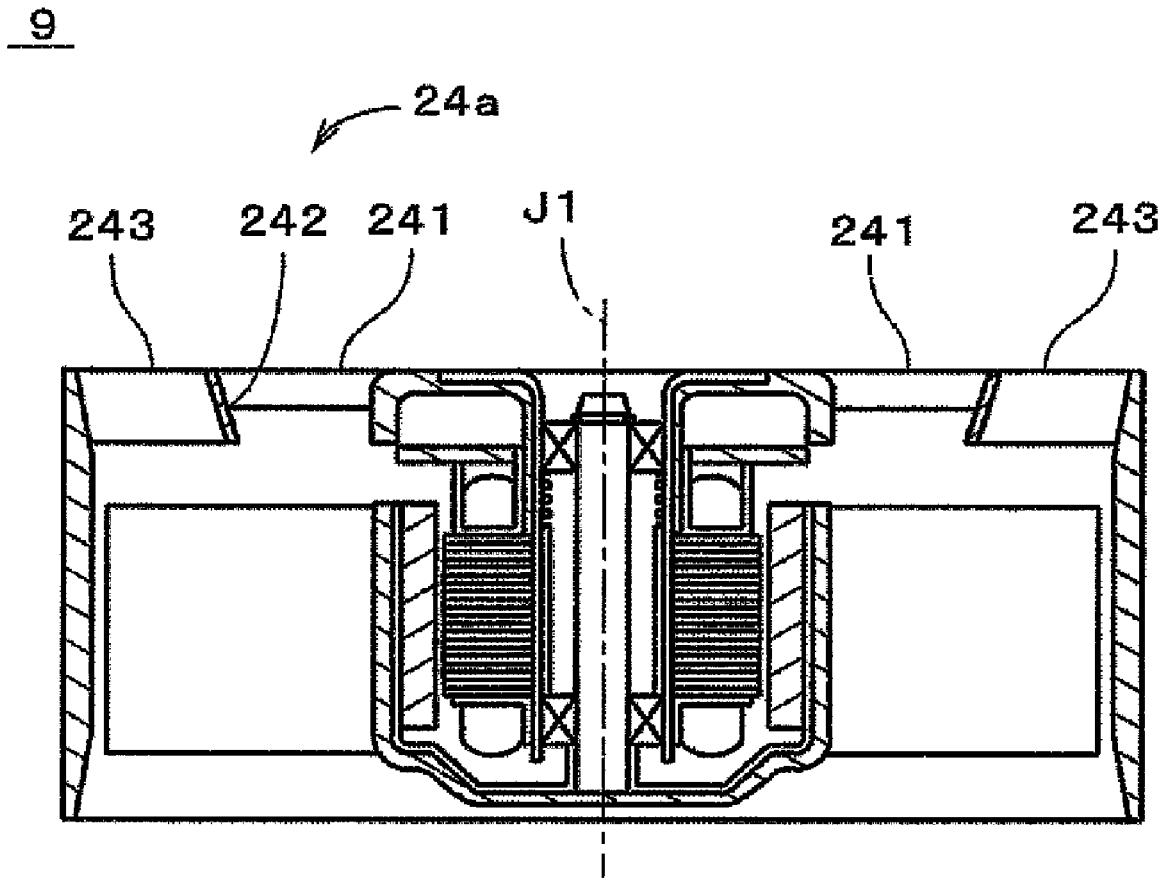
FIG. 15 is a schematic bottom view of an axial flow fan according to a ninth preferred embodiment of the present invention.

FIG. 15 is a schematic bottom view of an axial flow fan 9 according to a ninth preferred embodiment of the present invention. As shown in FIG. 15, the support portion 24*a* preferably includes, in the same manner as in the first preferred embodiment, the connecting member 242, the outer air guide member 243 and the inner air guide member 241.

As shown in FIG. 15, the support portion 24*a* is preferably arranged at the outlet side in the axial direction. When the impeller 21 rotates in the axial flow fan 9 according to the present preferred embodiment, the air flow is inletted from the side of the support portion 24*a* and flows downwardly in accordance with FIG. 15.

By virtue of such configuration, the air flow generated by the rotation of the impeller 21 will be adjusted by the support portion 24*a* and inletted into the housing 23. Therefore, the noise generated when the air flow makes contact with the impeller 21 and the inner side surface 231 of the housing 23 will be reduced.

While preferred embodiments of the present invention have been described in detail above, the foregoing description is in all aspects illustrative and not restrictive. It is understood that numerous other modifications and variations can be devised without departing from the scope of the invention.

For example, although some preferred embodiments above assume that the connecting member includes an inclination with respect to the central axis J1, the present invention is not limited thereto. Also, although the first preferred embodiment assumes that the inclination of the outer air guide member 243 with respect to the central axis J1 is greater than that of the inner air guide member 241, the present invention is not limited thereto.

Also, for the second preferred embodiment described above, the width of the outer air guide member 243*a* may be greater than that of the inner air guide member 241*a*.

Also, for the fourth preferred embodiment described above, the width of the outer air guide member 243*c* may be greater than that of the inner air guide member 241*c*. Also, the inclination of the outer air guide member 243*c* with respect to the central axis J1 may be smaller than that of the inner air guide member 241*c* such that the static pressure of the air flow generated by the rotation of the impeller 21 is improved.

Also, the shape of the outer air guide member and that of the inner air guide member when they are viewed in a cross sectional manner with respect to the direction each extends are not restrict to as those described above.

Also, the connecting member is not necessarily an annular shape. Also, although the preferred embodiments assume that the connecting member is a single component, the present invention is not limited thereto.

What is claimed is:

1. An axial flow fan comprising:

an impeller rotatable about a central axis and including a plurality of blades:

a hollow member accommodating therein the impeller;

a base portion arranged at the hollow member and supporting the impeller in a rotatable manner;

a plurality of inner air guide members each connected to the base member;

a plurality of outer air guide members each connected to the hollow member; and a connecting member having an axial height measured between an axially uppermost edge portion and an axially lowermost edge portion, the connecting member being arranged to connect the inner air guide members and the outer air guide members; wherein the inner air guide members and the outer air guide members each include a first edge portion that is an axially uppermost edge portion and a second edge portion that is an axially lowermost edge portion;

an axial height of the outer air guide member measured between the first edge portion and the second edge portion thereof is equal to or greater than an axial height of the inner air guide member measured between the first edge portion and the second edge portion;

an axial height of the outer air guide member measured between the first edge portion and the second edge portion thereof is equal or substantially equal to the axial height of the connecting member; and an axial height of the inner air guide member measured between the first edge portion and the second edge portion thereof is shorter than an axial height of the connecting member.

2. The axial flow fan according to the claim 1, wherein a straight line is a virtual line connecting the first edge portion and the second edge portion in each of the inner air guide members and the outer air guide members, and an angle defined between the straight line of the inner air guide members and the central axis is substantially equal to an angle defined between the straight line of the outer air guide members and the central axis.

3. The axial flow fan according to the claim 1, wherein a straight line is a virtual line connecting the first edge portion and the second edge portion in each of the inner air guide members and the outer air guide members, and an angle defined between the straight line of the inner air guide members and the central axis is different from an angle defined between the straight line of the outer air guide members and the central axis.

4. The axial flow fan according to claim 1, wherein a total number of the outer air guide members is greater than a total number of the inner air guide members.

5. The axial flow fan according to claim 1, wherein the inner air guide members and the outer air guide members each are connected to the connecting member at different circumferential positions from each other.

6. The axial flow fan according to claim 1, wherein at least one of the inner air guide members is connected to the connecting member at a circumferential position corresponding to one of the outer air guide members.

7. The axial flow fan according to claim 1, wherein a cross section of at least one of the inner air guide members includes a blade shape in a direction substantially perpendicular to a direction the inner air guide member extends, and a cross section of at least one of the outer air guide members includes a blade shape in a direction substantially perpendicular to a direction the outer air guide member extends.

8. The axial flow fan according to claim 1, wherein at least one of the inner air guide members is a rib.

9. The axial flow fan according to claim 1, wherein the connecting member includes a substantially annular shape when viewed from an axial end.

10. The axial flow fan according to claim 1, wherein a cross section of the connecting member includes a substantially blade shape or a substantially rectangle shape.

11. The axial flow fan according to claim 1, wherein the connecting member includes a surface which is substantially parallel with the central axis or inclined with respect to the central axis.

12. The axial flow fan according to claim 1, wherein at least one of the first edge portion and the second edge portion of the outer air guide members are arranged at substantially the same axial position as the connecting member.

13. The axial flow fan according to claim 1, wherein at least two of the inner air guide members, the connecting member, and the outer air guide members are arranged such that respective ones of the first edge portions and the second edge portions are arranged to be axially even with one another.

14. The axial flow fan according to claim 1, wherein the hollow member, the base portion, the inner air guide member, and the outer air guide member are provided as a single monolithic member.

15. The axial flow fan according to claim 1, wherein the hollow member includes an opening at an inlet side of an air flow and an outlet side of the air flow.

* * * * *